US006286742B1

(12) United States Patent
Mukoyama

(10) Patent No.: US 6,286,742 B1
(45) Date of Patent: Sep. 11, 2001

(54) NAIL DRIVING TOOL

(75) Inventor: Kenji Mukoyama, Okazaki (JP)

(73) Assignee: Makita Corporation, Anjo (JP)

( * ) Notice: Subject to any disclaimer, the term of this patent is extended or adjusted under 35 U.S.C. 154(b) by 0 days.

(21) Appl. No.: 09/495,850

(22) Filed: Feb. 1, 2000

(30) Foreign Application Priority Data

Feb. 2, 1999 (JP) ..... 11-025521

(51) Int. Cl.[7] ..... B25C 1/04; B27F 7/02
(52) U.S. Cl. ..... 227/8; 227/148; 227/156
(58) Field of Search ..... 227/8, 7, 142, 227/156, 148, 147, 119, 139, 130, 131, 120

(56) References Cited

U.S. PATENT DOCUMENTS

| | | | | |
|---|---|---|---|---|
| 2,851,689 | * | 9/1958 | McIlvin | 227/156 |
| 2,994,878 | * | 8/1961 | Abrahamsen | 227/148 |
| 3,011,169 | * | 12/1961 | Cast et al. | 227/8 |
| 4,405,071 | * | 9/1983 | Austin | 227/8 |
| 4,581,964 | * | 4/1986 | Takatsuru | 227/120 |
| 4,909,419 | * | 3/1990 | Yamada et al. | 227/8 |
| 5,074,453 | * | 12/1991 | Tachihara et al. | 227/119 |
| 5,219,110 | * | 6/1993 | Mukoyama | 227/142 |
| 5,222,646 | * | 6/1993 | Mukoyama | 227/148 |
| 5,405,071 | * | 4/1995 | Baugus | 227/156 |
| 5,649,661 | * | 7/1997 | Masuno et al. | 227/8 |
| 5,667,127 | * | 9/1997 | Ichikawa et al. | 227/8 |
| 5,687,899 | * | 11/1997 | Dohi et al. | 227/8 |
| 5,715,982 | * | 2/1998 | Adachi | 227/8 |
| 5,810,239 | * | 9/1998 | Stich | 227/147 |
| 5,996,874 | * | 12/1999 | Fukushima et al. | 227/8 |

FOREIGN PATENT DOCUMENTS

| | | | | |
|---|---|---|---|---|
| 2437063 | * | 2/1976 | (DE) | 227/148 |
| 2511319 | * | 9/1976 | (DE) | 227/148 |
| 251097 | | 4/1990 | (JP) . | |

* cited by examiner

*Primary Examiner*—Scott A. Smith
(74) *Attorney, Agent, or Firm*—Davis & Bujold, P.L.L.C.

(57) ABSTRACT

There is proposed a nail driving tool provided with a driver guide including an injection hole for driving a nail and a contact arm surrounding an outer surface of a forward end of the driver guide in a nail driving direction, provided with an eject hole penetrating through the contact arm, movable on an axial line along the nail driving direction for making triggering operation for driving a nail effective by being moved in the opposite direction to the nail driving direction and designed to drive a nail outwardly through the eject hole, wherein a diameter of an outer surface of a forward end portion of the contact arm is decreased taperingly toward its edge in the nail driving direction. A diameter of the eject hole of the contact arm in the vicinity of the forward end of the contact arm in the nail driving direction is nearly equal to that of the injection hole of the driver guide in the vicinity of the forward end of the driver guide in the nail driving direction and an outer diameter of the contact arm in the vicinity of the forward end of the contact arm is equal to or smaller than an outer diameter of the driver guide in the vicinity of the forward end of the driver guide. A spike is provided on the outer surface of the forward end portion of the contact arm for preventing slippage of the contact arm when a nail is driven obliquely. It is easy for the user of the nail driving tool to see and aim at the point to drive a nail.

16 Claims, 9 Drawing Sheets

NAIL DRIVING TOOL

FIELD OF THE INVENTION

The invention relates to a nail driving tool.

BACKGROUND OF THE INVENTION

Heretofore, for example, as shown in Publication of Unexamined Japanese Utility Model Application No, 2-51079, there is known a nail driving tool provided with a driver guide having an injection hole for driving a nail and a contact arm surrounding an outer surface of a forward end of the driver guide in a nail driving direction, movable on an axial line along the nail driving direction, for making triggering operation for driving a nail effective by being moved in the opposite direction to the nail driving direction.

However, it is difficult for the user of such a conventional nail driving tool to see and aim at the point for driving a nail, since a size of a forward end portion of the contact arm in the nail driving direction is large.

SUMMARY OF THE INVENTION

An object of the invention is to provide a nail driving tool by which the user can easily see and aim at the point for driving a nail.

The object of the invention is attained by providing a nail driving tool provided with a driver guide including an injection hole for driving a nail and a contact arm surrounding an outer surface of a forward end of the driver guide in a nail driving direction, provided with an eject hole penetrating through the contact arm along the nail driving direction and movable on an axial line along the nail driving direction, for making triggering operation for driving a nail by being moved in the opposite direction to the nail driving direction, wherein a diameter of an outer surface of the contact arm is decreased taperingly toward its edge in the nail driving direction.

The diameter of the outer surface of the contact arm in the vicinity of the forward end of the contact arm in the nail driving direction may be preferably equal to or smaller than a diameter of an outer surface of the driver guide in the vicinity of the forward end of the driver guide in the nail driving direction.

According to the nail driving tool of the invention, the user can easily see and aim at the point to drive a nail.

Moreover, an inner diameter of the eject hole of the contact arm in the vicinity of the forward end of the contact arm in the nail driving direction may be nearly equal to an inner diameter of the injection hole of the driver guide in the vicinity of the forward end of the driver guide in the nail driving direction.

In this case, since a nail driven from the injection hole of the driver guide is guided by an inner surface of the eject hole, the nail driven to the outside via the eject hole becomes less easily leaned, thereby a problem like buckling of the nail being prevented. Therefore, driving of a nail can be performed in desirable condition.

Moreover, a spike for preventing slippage of the contact arm when driving a nail obliquely may preferably be provided on an outer surface of a forward end portion of the contact arm in the nail driving direction.

When a nail is driven obliquely into an object material such as wood and the like, if the spike is stuck in the surface of the object material before driving a nail, the forward end portion of the contact arm can be fixed on the surface and so a nail can be driven exactly at the aimed point.

Moreover, there may be further provided with an adapter with a through hole penetrating through the adapter itself along the nail driving direction, which can be detachably attached to the forward end portion of the contact arm in the nail driving direction by inserting the forward end portion into the through hole. At least on one side of the adapter and the forward end portion of the contact arm, a means may be provided for determining a circumferential attachment position which determines a position of the adapter relative to the contact arm among a plurality of different positions along the circumferential direction of the contact arm around a center line of the through hole of the adapter.

By using the means, the circumferential attachment position of the adapter can be changed to a desired position without exchanging the adapter to another one, when it becomes necessary to change the circumferential attachment position on driving a nail.

Therefore, according to the nail driving tool of the invention, a plurality of adapters corresponding to the respective desired circumferential attachment positions are not necessary and the circumferential attachment position can be changed using only one adapter.

Moreover since there is no need to exchange the adapter when changing the circumferential attachment position, the efficiency of the nail driving operation is improved.

The means for determining the circumferential attachment position is preferably constituted such that at least two recesses are provided on one side of the inner surface of the through hole of the adapter and the outer surface of the forward end portion of the contact arm, protrusions of one or more, equal to or less than the number of the recesses, are provided on the other side of the surfaces that is not provided with the recesses, and the protrusions are designed to be engaged with the recesses on different positions corresponding to the circumferential attachment position of the adapter relative to the contact arm, when the adapter is attached to the forward end portion of the contact arm.

According to the means, the adapter is securely held in the desired circumferential attachment position by engaging the protrusions with the recesses, though the circumferential attachment positions of the adapter are restricted to the positions where the protrusions engage with the recesses.

Moreover, a groove is provided on one side of the inner surface of the through hole of the adapter and the outer surface of the forward end portion of the contact arm along the circumference, and on the other side that is not provided with the groove, an engaging protrusion is provided at a position corresponding to the groove. When the adapter is attached to the forward end portion of the contact arm, the engaging protrusion is engaged with the groove. Then, even when the adapter is rotated on the contact arm around the center line of the through hole of the adapter, the engaging protrusion slides in the groove and the position of the adapter relative to the contact arm in the nail driving direction does not change.

According to such a nail driving tool, even when the circumferential attachment position of the adapter is changed by the operator's hand of the nail driving tool after attaching the adapter, the position of the adapter in the nail driving direction can always be kept constant and a driving depth of a nail driven from the nail driving tool in the object can be kept constant.

Specifically, if the position of the adapter in the nail driving direction is changed, for example, when the circumferential attachment position of the adapter is changed, the driving depth of the nail driven from the nail driving tool in the object is changed. But by providing the groove and engaging protrusion and engaging them with each other, as mentioned above, the position of the adapter in the nail driving direction can be kept unchanged and driving depth of nails in the object can be always kept constant before and after the circumferential attachment position is changed, even if the circumferential attachment position is changed by the operator's hand of the nail driving tool after attaching the adapter.

If the above-mentioned protrusions and recesses are further provided as well as the above-mentioned groove and engaging protrusion, the protrusions become easily engaged with the recesses when the adapter is rotated around the center line of the through hole of the adapter after attaching the adapter.

Specifically, after the adapter is attached, since the position of the adapter in the nail driving direction is always kept constant by the engaging protrusion being slid in the groove during the process of changing the circumferential attachment position, there is no need to do such a work necessary in the case where a groove and an engaging protrusion are not provided, in which a position where the protrusions are properly engaged with the recesses has to be groped for by changing the position of the adapter in the nail driving direction.

Moreover, in the above-mentioned nail driving tool, an inner diameter of the through hole of the adapter in the part forward from the position which the edge of the contact arm in the nail driving direction abuts, when the adapter is attached to the forward end portion of the contact arm, may be designed to be equal to or smaller than that of the eject hole of the contact arm in the vicinity of the edge of the contact arm in the nail driving direction.

In this case, when the nail-driving operation is carried out, the part of the inner surface of the through hole of the adapter farther than the position which the edge of the contact arm abuts functions as a glide for nails, thereby preventing the nails from leaning while passing along the part or buckling when driven, compared with a nail driving tool wherein the inner diameter of the through hole of an adapter in the part farther than the edge of the contact arm in the nail driving direction is approximately the same as the outer diameter of the contact arm in the vicinity of the edge thereof.

Moreover, the adapter may be provided at its end part in the nail driving direction with a projection formed of two opposing outer surfaces of the adapter across the center line of the through hole increasingly approaching a plane including the center line of the through hole of the adapter.

BRIEF DESCRIPTION OF THE DRAWING FIGURES

The invention will now be described, by way of example, with reference to the accompanying drawings, in which:

FIG. 1 is a side view of a nail driving tool of the first embodiment;

FIGS. 2A and 2B are drawings for explaining a structure of the part around a forward end portion of a contact arm of the first embodiment; FIG. 2A is a longitudinal sectional view of the part; FIG. 2B is a bottom view of the part;

Figure 5A:
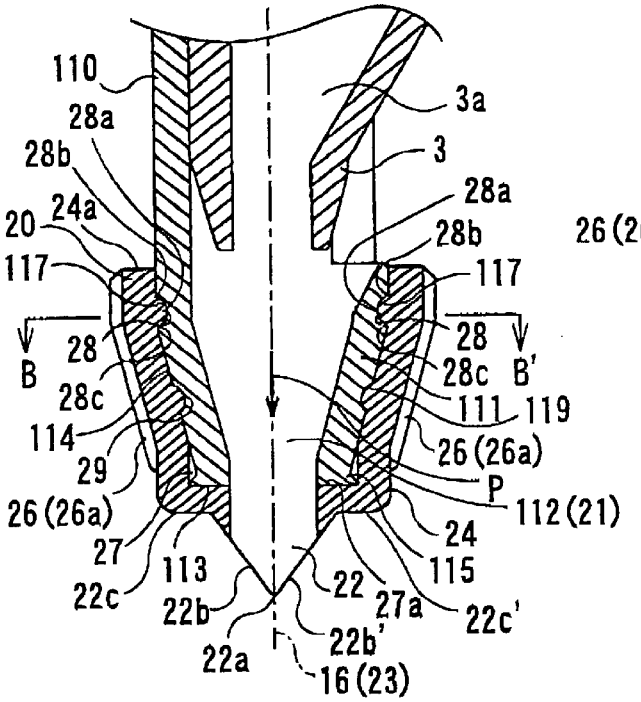
Figure 5B:
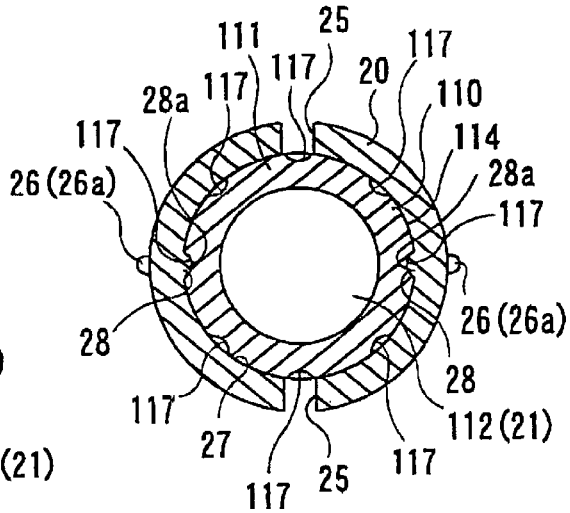
Figure 6A:
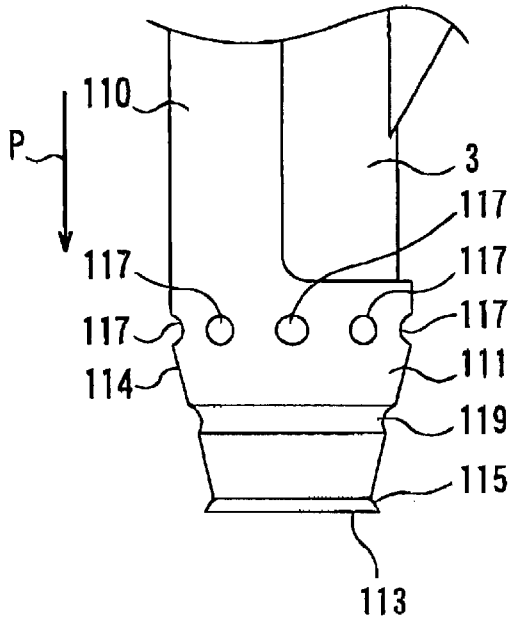
Figure 6C:
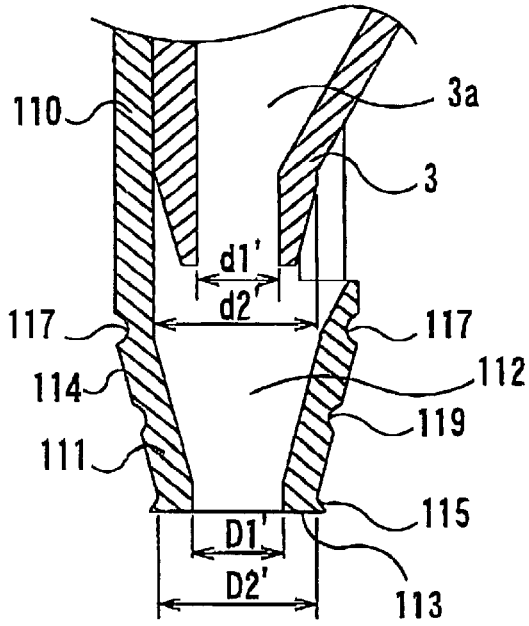
Figure 6B:
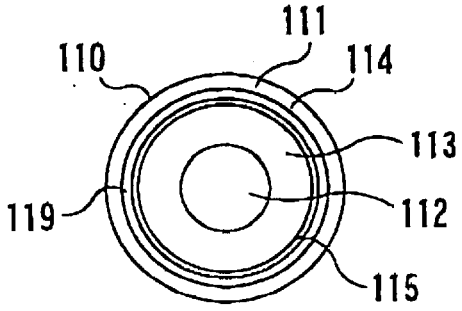
Figure 7B:
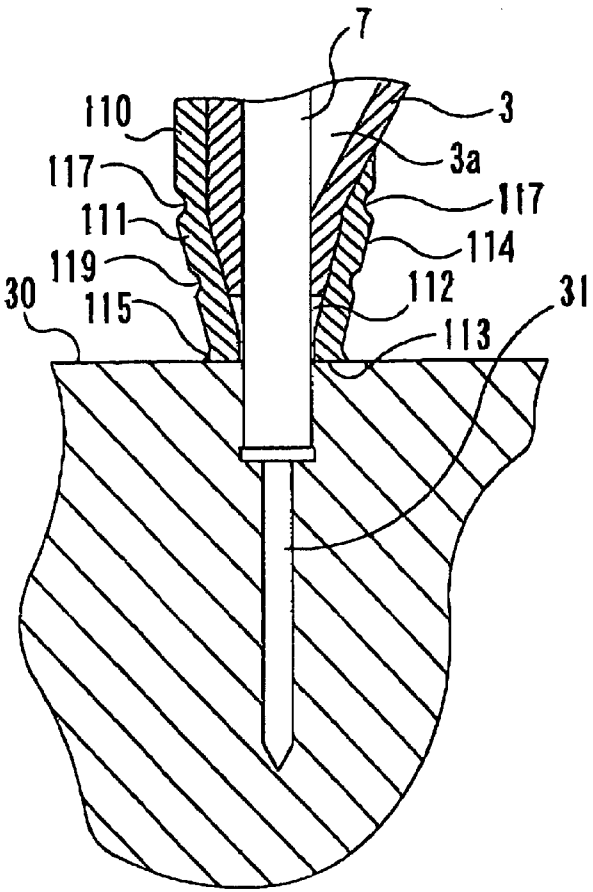
Figure 7A:
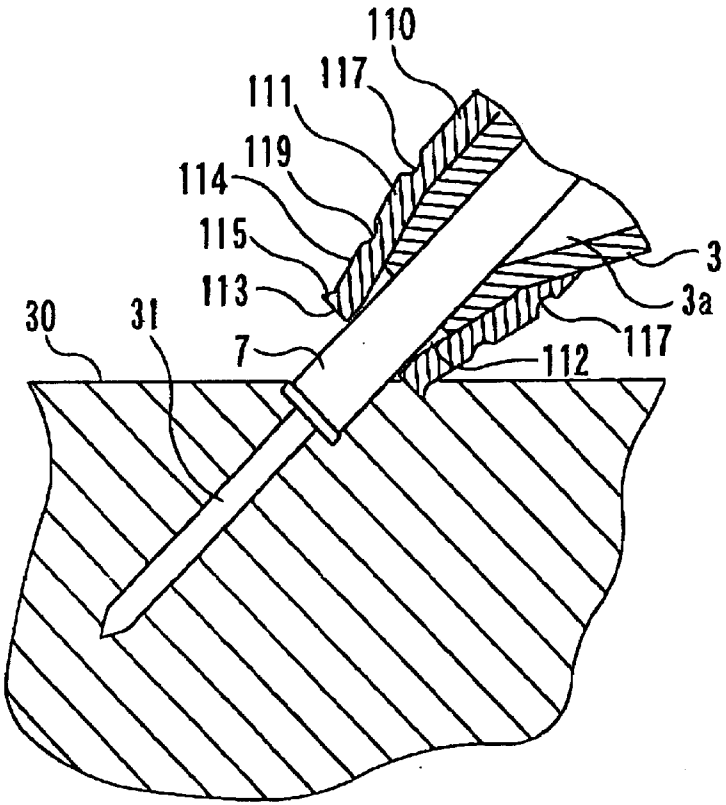
Figure 8A:
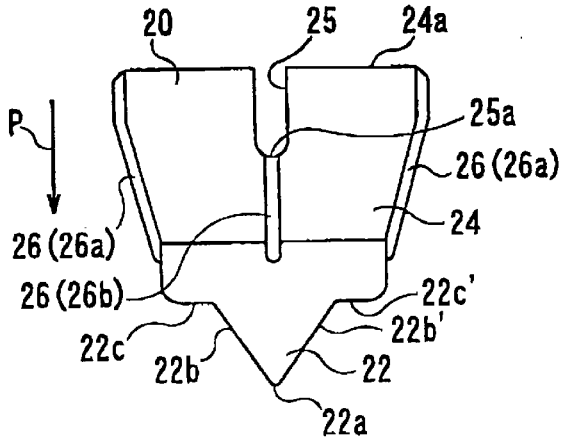
Figure 8B:
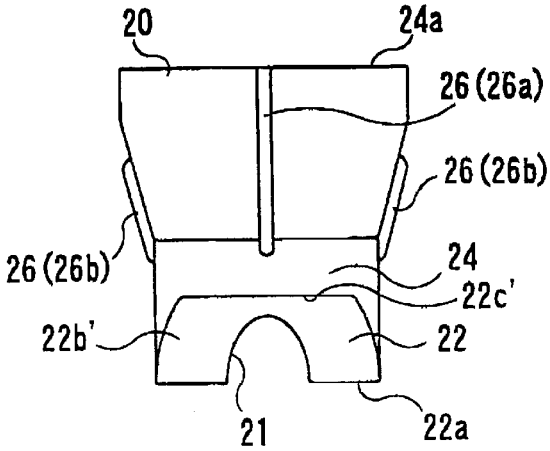
Figure 8C:
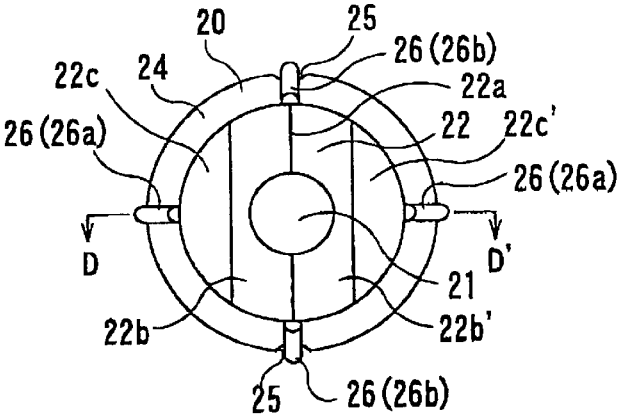
Figure 8D:
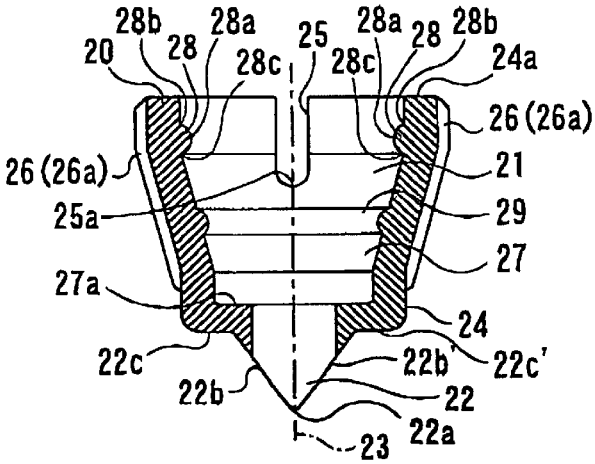
Figure 9:
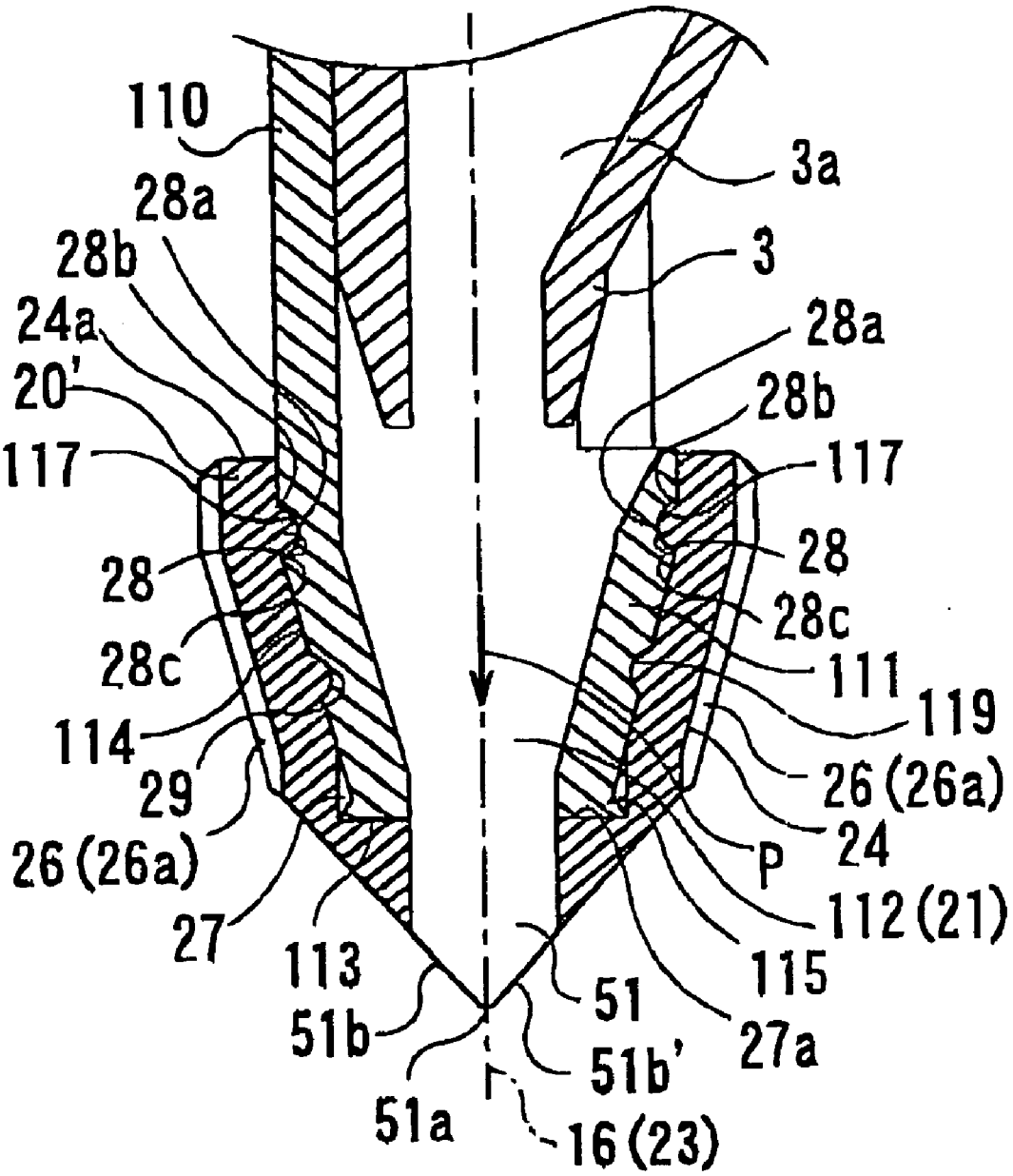

FIGS. 5A and 5B are drawings for explaining a state in which an adapter is attached to a forward end portion of a contact arm of the second embodiment; FIG. 5A is a longitudinal sectional view for explaining a structure of the part of the nail driving tool around the adapter attached; FIG. 5B is a sectional view of FIG. 5A taken along the line B—B';

FIGS. 6A to 6C are drawings for showing the part around the forward end portion of the contact arm of the nail driving tool of the second embodiment in a state without the adapter; FIGS. 6A, 6B and 6C are a side view, a bottom view and a longitudinal sectional view of the part, respectively (FIG. 6C is a longitudinal sectional view of a state in which the adapter is removed from the constituents in FIG. 5A );

FIGS. 7A and 7B are drawings for explaining states of use of the nail driving tool without the adapter of the second embodiment, using longitudinal sectional views of the part around the forward end portion of the contact arm;

FIGS. 8A to 8D are drawings for explaining a shape of the adapter of the nail driving tool of the second embodiment; FIGS. 8A, 8B and 8C are a side view, a front view and a bottom view of the adapter, respectively; FIG. 8D is a sectional view of FIG. 8C taken along the line D—D'; and FIG. 9 is a drawing for explaining a state in which an adapter is attached to an forward end portion of a contact arm of a nail driving tool of the third embodiment and is a longitudinal sectional view showing a structure around the part of the nail driving tool where the adapter is attached.

DETAILED DESCRIPTION OF THE PREFERRED EMBODIMENT

First Embodiment

Figure 1:
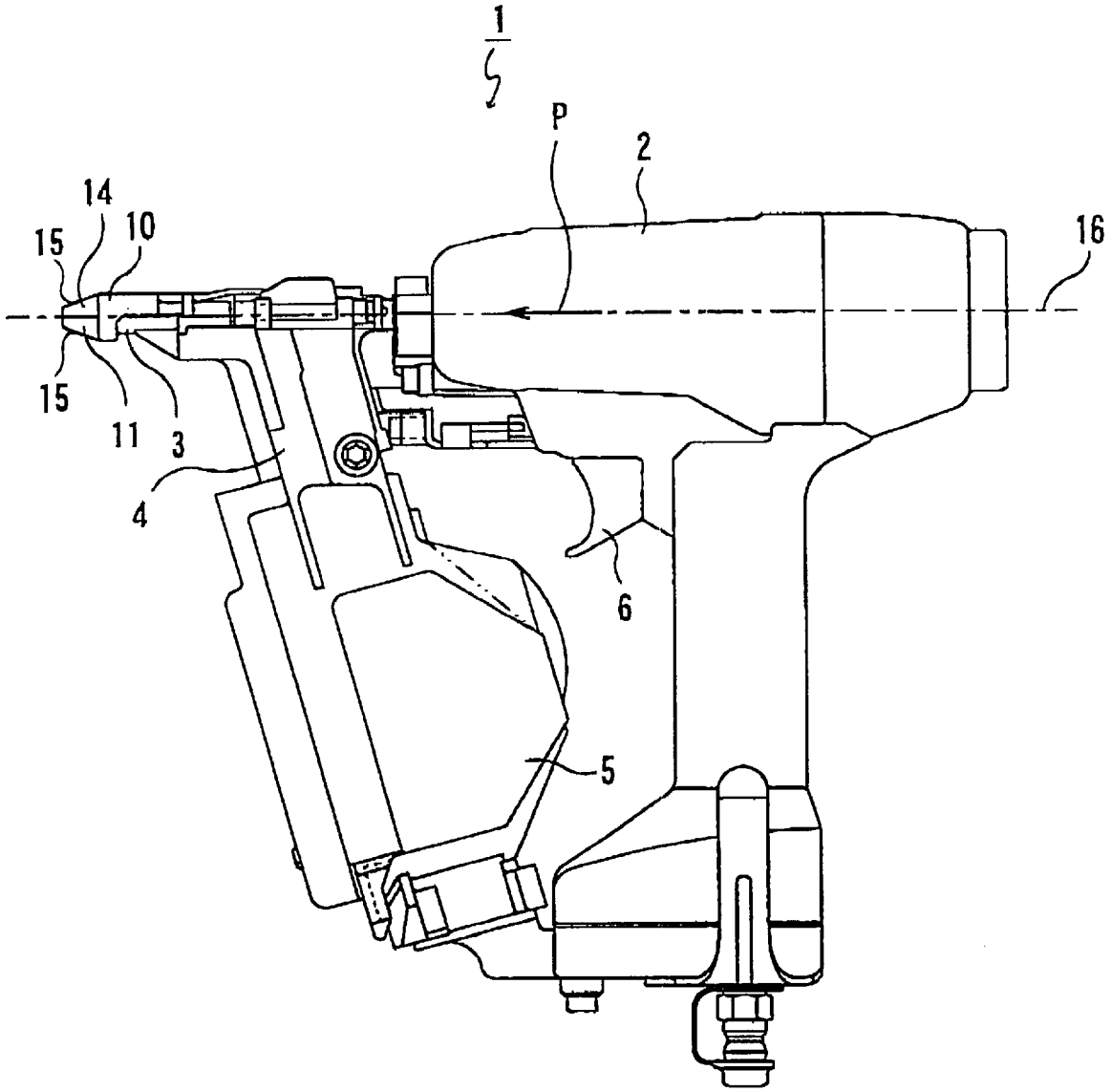
Figure 2A:
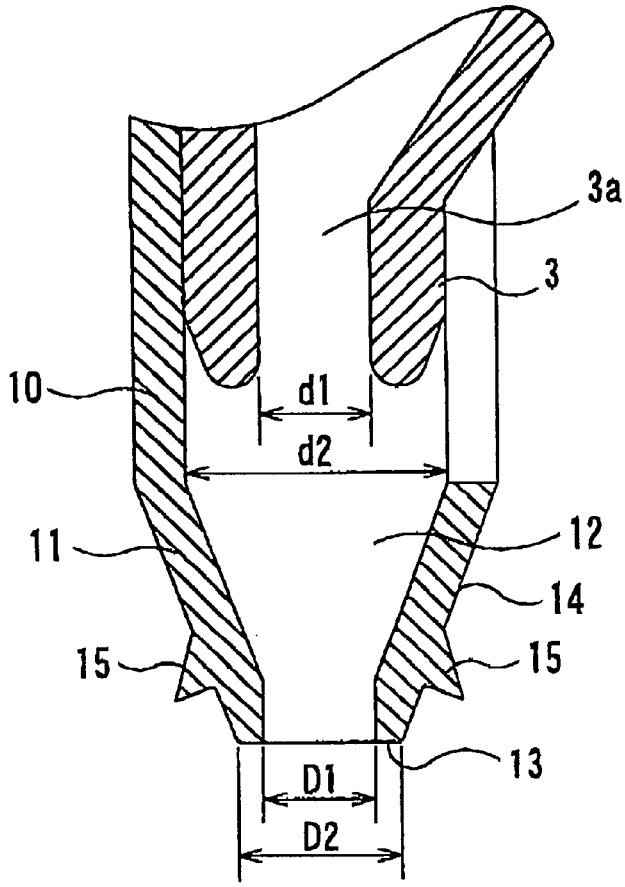
Figure 2B:
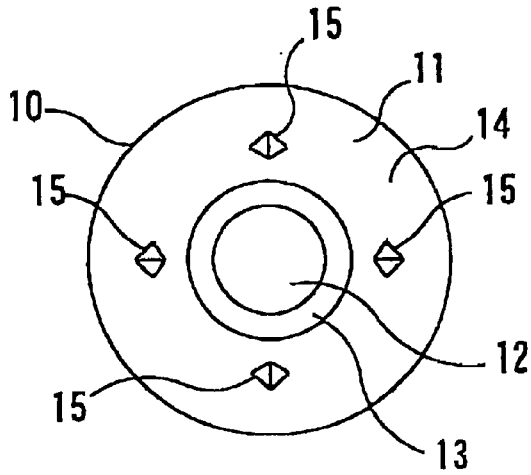

Referring to FIGS. 1, 2A, and 2B, a nail driving tool 1 according to a first embodiment of the present invention is described.

The nail driving tool 1 is provided with a main body 2 which houses a driver reciprocally moved by air pressure to drive a nail. A driver guide 3 is connected to the main body 2 so as to extend in the nail driving direction (indicated by an arrow P in FIG. 1) To the side of the driver guide 3 is attached a nail feeding portion 4 for feeding nails into the driver guide 3. The opposite end of the nail feeding portion 4 to the driver guide 3 is connected to a magazine 5 for housing a rolled assembly of nails (not shown) and feeding the nails into the nail feeding portion 4.

The driver guide 3 includes an injection hole 3*a* (cf. FIG. 2A) through which a nail is driven by the driver. A contact arm 10 having an eject hole 12 (cf. FIGS. 2A and 2B) extending in the nail driving direction is disposed so as to surround the outer surface of a forward end of the driver guide 3 in the nail driving direction. The contact arm 10 is configured to allow slidable movement along an axis 16 along the nail driving direction. The nail driving tool 1 is constituted such that the operation of a trigger 6 for driving a nail is effected by the contact arm 10 being moved in the opposite direction to the nail driving direction.

As shown in FIG. 2B, the outer surface 14 of the forward end portion 11 of the contact arm 10 is configured to have an approximately circular cross-section taken along a plane perpendicular to the nail driving direction.

The outer surface 14 of the forward end portion 11 is tapered such that the outer diameter thereof is gradually decreased toward an edge 18 in the nail driving direction. Specifically, as shown in FIG. 2A, an inner diameter D1 of the eject hole 12 in the vicinity of the forward end (the edge 13) and an inner diameter d1 of the injection hole 3*a* in the vicinity of the forward end of the driver guide 3 are approximately the same. An outer diameter D2 of the contact arm 10 in the vicinity of the edge 13 is equal to or smaller than an outer diameter d2 of the driver guide 3 in the vicinity of the forward end (D2<d2 in the present embodiment).

A plurality of spikes 15 (four spikes in the present embodiment) are provided on the outer surface 14 to protrude therefrom. Specifically, the spikes 15 are formed at 90° intervals in the circumferential direction of the outer surface 14 in order to prevent the point to drive a nail from deviating from the right point (i.e. slippage) when driving the nail obliquely into the surface of an object material such as a wooden board.

The above-described nail driving tool 1 operates in the following manner.

Figure 3B:
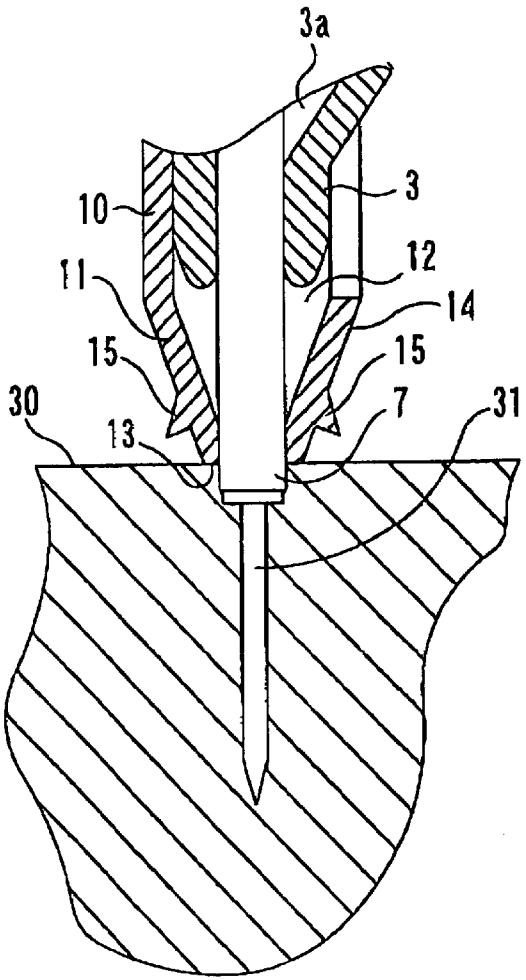
FIGS. 3A and 3B are drawings for explaining states of use of the nail driving tool of the first embodiment, using longitudinal sectional views of the part around the forward end portion of the contact arm.
Figure 3A:
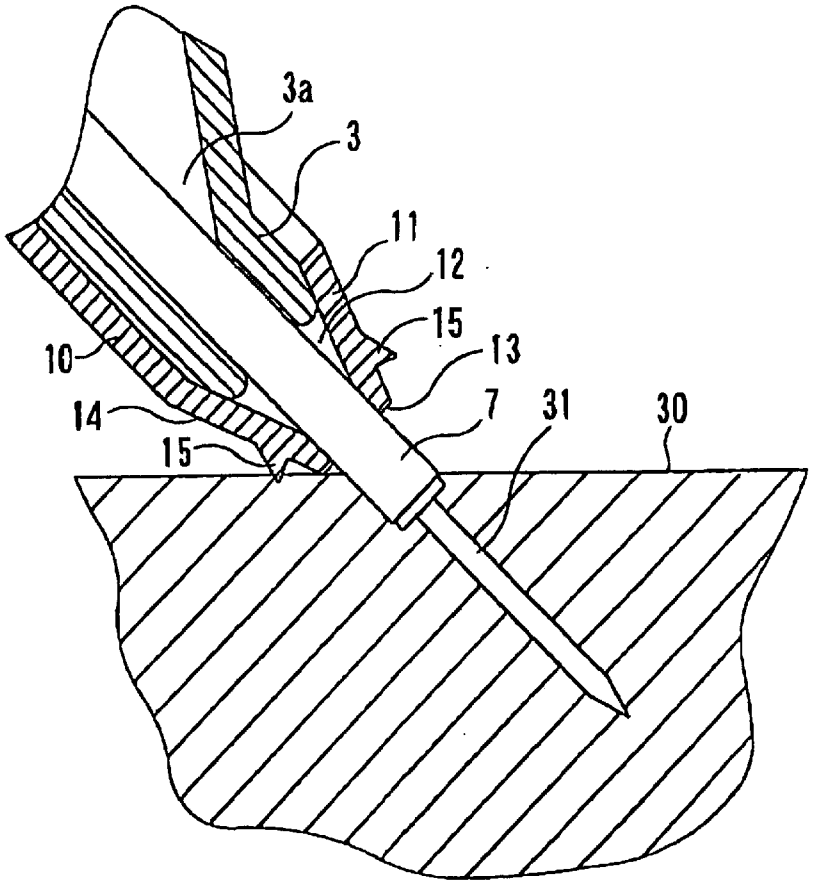

In the case, as shown in FIG. 3A, where a nail 31 is driven obliquely into the surface 30 of the object material, the forward end portion 11 of the contact arm 10 is pressed against the surface 30 so that the spikes 15 are stuck in the surface 30 and the contact arm 10 is retracted backwardly, then a trigger 6 is pulled. As the forward end portion 11 of the contact arm 10 is tapered, it is easy for the user of the nail driving tool 1 to see and aim at the point to drive the nail 31. Also, as the spikes 15 are stuck in the surface 30, the forward end portion 11 is fixed on the surface and therefore the user can drive the nail exactly at the aimed point.

In the case, as shown in FIG. 3B, where the nail 31 is driven into the surface 30 perpendicularly, the edge 13 is pressed on the surface 30 and the contact arm 10 is retracted backwardly, then a trigger 6 is pulled. Also in this case, as the forward end portion 11 of the contact arm 10 is tapered, it is easy for the user to see and aim at the point to drive the nail 31 A driver 7, shown in FIGS. 3A and 3B, is reciprocally moved by air pressure along the axis 16 (cf FIG. 1) to drive the nail 31.

In the present embodiment, as explained above, the outer surface 14 of the forward end portion 11 is generally tapered, that is, the outer diameter thereof is gradually decreased toward the edge 13 except some points where the spikes 15 are formed, the user can easily see and aim at the point to drive the nail 31 when driving the nail 31 into the surface 30 from any directions.

Also, when the nail 31 is driven obliquely into the surface 30, the spikes 15 can prevent slippage of the forward end portion 11 on the surface 30, so that the nail 31 is driven exactly at the aimed point.

Moreover, since the inner diameter D1 of the eject hole 12 in the vicinity of the edge 13 and the inner diameter d1 of the injection hole 3*a* in the vicinity of the forward end of the driver guide 3 are approximately the same, the nail 31 injected from the injection hole 3*a* is guided by the inner surface of the eject hole 12 of the contact arm 10 in the vicinity of the edge 13. As a result, the nail 31 is prevented from leaning while passing along the inner surface or buckling when driven into the surface 30 That is, the nail driving can be performed in desirable condition.

Second Embodiment

A second embodiment of the present invention is explained with reference to the attached drawings. Similar elements to those in the first embodiment are given the same signs, respectively, and the explanation of the same is omitted or simplified.

Figure 4:
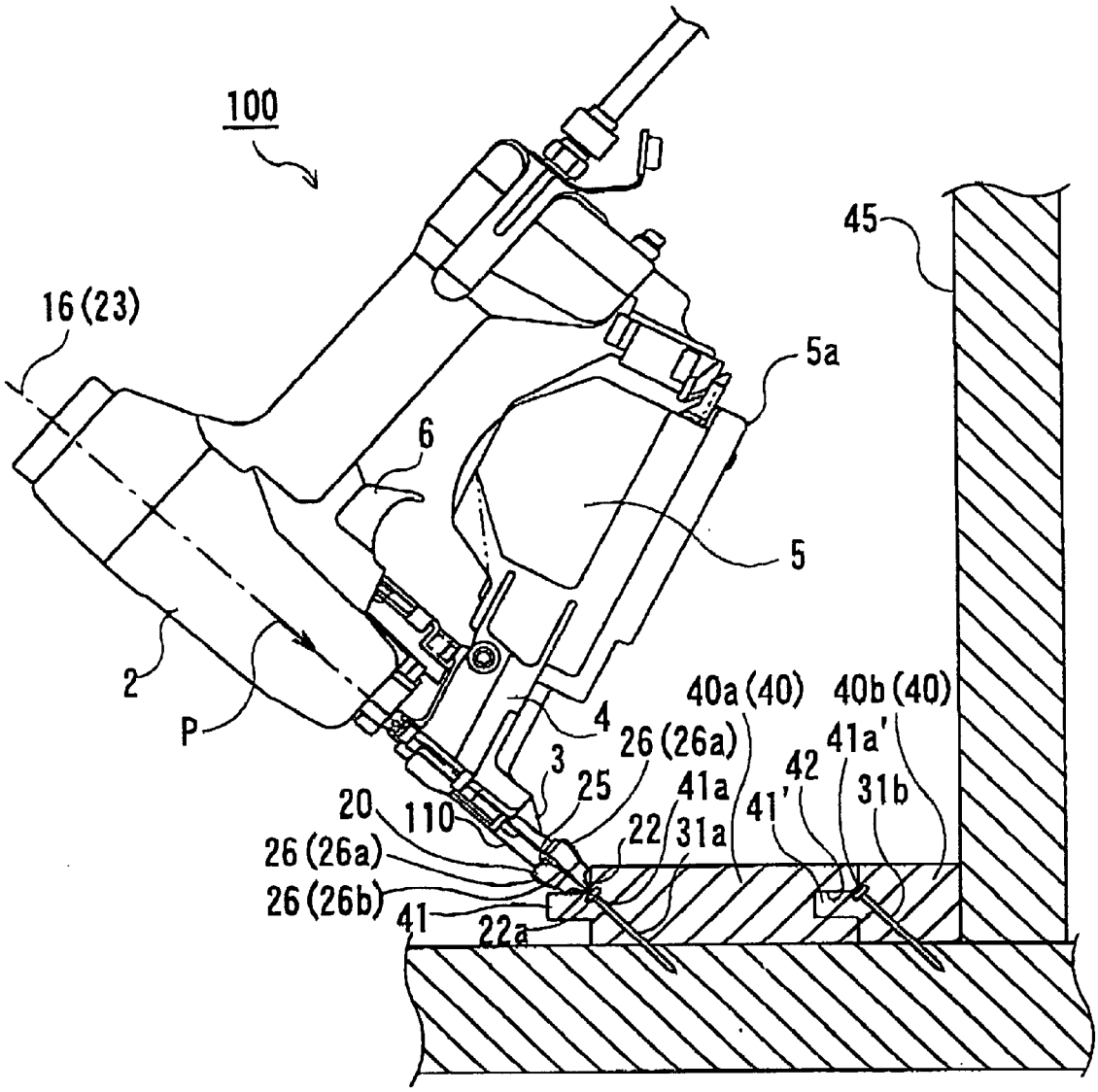
FIG. 4 is a drawing for explaining a state of operation carried out with a nail driving tool of the second embodiment.

FIG. 4 shows how to drive nails 31*a*, 31*b* into floorboards 40 as a flooring material to fix the same by using a nail driving tool 100 according to the present embodiment.

The floorboard 40 (specifically a floorboard 40*a* other than a floorboard 40*b* with its one side abutting a wall 45) has a side protrusion 41 and a side recess 42 on respective sides. The floorboard 40*b* abutting the wall 45 has a side protrusion 41' on the opposite side to the wall 45.

The nails 31*a*, 31*b* are driven into the floorboards 40 obliquely at root corners 41*a*, 41*a*' of the side protrusions 41, 41'. Then, the side protrusion 41 is engaged with the side recess 42 of another floorboard 40, and thus a plurality of floorboards 40 are fixed by repeating the above operation.

The nail driving tool 100 according to the present embodiment is provided with an adapter 20 for the floorboard 40 attached on a forward end portion 11 of a contact arm 110 to enable the driving of the nails 31*a*, 31*b*. In the nail driving tool 100, all elements except the adapter 20 and the forward end portion 111 of the contact arm 110 have approximately the same configurations, respectively, as those of the corresponding elements in the nail driving tool 1 of the first embodiment.

The adapter 20, having a through hole 21 extending in a nail driving direction (cf FIGS. 5A and 5B), is detachably attached to the forward end portion 111 of the contact arm 110 by engaging the inside of the through hole 21 with the forward end portion 111.

The configuration of the forward end portion 111 of the contact arm 110 is explained in detail with reference to FIGS. 6A through 6C as well as FIGS. 5A and 5B.

In the same manner as in the first embodiment, an outer surface 114 of the forward end portion 111 of the contact arm 110 is configured such that it has an approximately circular cross-section taken along a plane perpendicular to the nail driving direction.

The outer surface 114 of the forward end portion 111 is also tapered such that the outer diameter thereof is gradually decreased toward an edge 113 in the nail driving direction. Specifically, as shown in FIG. 6C, an inner diameter D1' of an eject hole 112 in the vicinity of the edge 113 of the contact arm 110 in the nail driving direction and an inner diameter d1' of an injection hole 3*a* in the vicinity of the forward end of the driver guide 3 are approximately the same. An outer diameter D2' of the contact arm 110 in the vicinity of the edge 113 (specifically the outer diameter D2' without taking a later-described spike 115 into account) is equal to or smaller than an outer diameter d2' of the driver guide 3 in the vicinity of the forward end (D2' is approximately equal to d2' in the present embodiment).

Therefore, when the nail driving operation is performed without using the adapter 20 as shown in FIGS. 7A and 7B, the user can easily see and aim at a point to drive a nail 31 as in the first embodiment. Also, since the nail 31 injected from the injection hole 3*a* is guided by the inner surface of the eject hole 112 of the contact arm 110 in the vicinity of the edge 113, the nail 31 is prevented from leaning while passing along the inner surface or being bent when driven into the surface 30. That is, the nail driving can be performed in desirable condition.

An annular protruding spike 115 is formed so as to surround the outer surface 114 of the forward end portion 111 in the vicinity of the edge 113, which prevents deviation of the nail driving point when driving the nail 31 obliquely into the surface 30. Specifically by sticking the spike 115 into the surface 30 before the nail driving without using the adapter 20 (cf FIG. 7A), the forward end portion 111 can be fixed to the surface 30, so that the user of the nail driving tool 100 can drive the nail 31 exactly at the aimed point.

A plurality of recesses 117 (eight recesses in the present embodiment) and a groove 119 are formed in the outer surface 114 of the forward end portion 111 (cf. FIG. 6A). The eight recesses 117 arranged at 45° intervals in the circumferential direction of the outer surface 114 have approximately the same configuration (cf. FIG. 5B). The groove 119 is arranged between the recesses 117 of the outer surface 114 and the edge 113 as shown in FIGS. 6A through 6C. The groove 119 formed to extend in the circumferential direction of the outer surface 114 is a perfect annular groove in the present embodiment.

The adapter 20 is explained in detail with reference to FIGS. 8A through 8D as well as FIGS. 4, 5A, and 5B.

The adapter 20 composed of an elastic material such as hard rubber is configured such that the forward end portion 111 of the contact arm 110 is engaged with the through hole 21. The adapter 20 has a projection 22 or ridge at the end thereof in the nail driving direction. Specifically, at the end of the adapter 20 in the nail driving direction are formed shoulders 22*c*, 22*c*' in the outer surface 24 of the adapter 20 across the center line 23 (cf. FIG. 8D) of the through hole 21. The projection 22 includes portions 22*b*, 22*b*' which are configured such that the outer surface 24 protrudes in the nail driving direction from the ends of the shoulders 22*c*, 22*c*' on the side of the center line 23 increasingly approaching a plane (not shown) including the center line 23 linearly. In the present invention, an edge 22*a* of the projection 22 in the nail driving direction is on the above plane including the center line 23.

The outer surface 24 of the adapter 20 has a plurality of slits 25 (two slits in the present embodiment) communicating with the through hole 21 and a plurality of elongate protrusions 26 (four protrusions in the present embodiment).

The two slits 25 are arranged in the outer surface 24 oppositely across the through hole 21, that is, at 180° intervals in the circumferential direction of the outer surface 24. Each of the slits 25 extends from a predetermined point of the outer surface 24 to an upper end 24*a* thereof opposite to the nail driving direction.

The four elongate protrusions 26 are arranged at 90° intervals in the circumferential direction of the outer surface 24, and each of the protrusions 26 extends in the nail driving direction. The four elongate protrusions 26 consists of two longer elongate protrusions 26*a* and two shorter elongate protrusions 26*b*. The longer protrusion 26*a* each has an end opposite to the nail driving direction in the vicinity of the upper end 24*a* of the outer surface 24, and the shorter protrusion 26*b* each has an end opposite to the nail driving direction in the vicinity of a closed end 25*a* of the slit 25.

An inner surface 27 defining the through hole 21 has an approximately circular cross-section taken along a plane perpendicular to the nail driving direction, which is designed to correspond to the configuration of the forward end portion 111. The inner surface 27 includes an abutting surface 27*a* formed in the nail driving direction, which abuts the edge 113 when the forward end portion 111 is inserted into the through hole 21.

The diameter of the through hole 21 in the part forward from the abutting surface 27*a*, which the edge 113 abuts when the adapter 20 is fitted on the forward end portion 111 of the contact arm 110 by engaging the forward end portion 111 with the through hole 21, is approximately the same as the inner diameter of the eject hole 112 in the vicinity of the edge 113 (cf. FIG. 2A). As a result, the part functions as a guide for the nail, and therefore prevents the nail from leaning while passing along the part or buckling when driven, compared with a nail driving tool wherein the diameter of the through hole of an adapter in the part forward from the edge of the contact arm in the nail driving direction is approximately the same as the outer diameter of the contact arm in the vicinity of the edge thereof.

The inner surface 27 is provided with protrusions 28 of a smaller number (two in the present embodiment) than that of the recesses 117, and an elongate engaging protrusion 29 (cf. FIGS. 5B and 8D).

The two protrusions 28 are arranged on the inner surface 27 oppositely across the through hole 21, that is, at 180° intervals in the circumferential direction of the inner surface 27 and have approximately the same configuration. As described later, the two protrusions 28 are engaged with the corresponding two recesses 117, respectively, when the adapter 20 is attached on the forward end portion 111 of the contact arm 110.

The engaging protrusion 29 extending along the circumferential direction on the inner surface 27 specifically forms an annular protrusion in the present embodiment. As described later, the engaging protrusion 29 is engaged with the corresponding groove 119 when the adapter 20 is attached on the forward end portion 111 of the contact arm 110.

The adapter 20 is attached to the forward end portion 111 of the contact arm 110, as shown in FIGS. 4, 5A and 6B, in the following manner.

Firstly, the forward end portion 111 is inserted into the through hole 21 and the adapter 20 is elastically deformed, whereby the engaging protrusion 29 is engaged with the groove 119 and the edge 113 abuts the abutting surface 27*a*.

Then, the adapter 20 is rotated around the center line 23 (the axis 16) to engage the two protrusions 28 thereof with desired two recesses 117. The attachment of the adapter 20 is thus completed.

Since the adapter 20 in the present embodiment is made of hard rubber, which is relatively easy to elastically deform, and has two slits 25, even a small force can elastically deform the adapter 20 That is, the user of the nail driving tool 100 can easily attach the adapter 20 with his/her hands.

When attaching the adapter 20, the four elongate protrusions 26 thereof can be used as guides indicating the position of the adapter 20 relative to the forward end portion 111.

The nail driving tool 100 with the adapter 20 attached thereon enables exact nail driving at the root corner 40*a* of the floorboard 40*a*. Specifically, as shown in FIG. 4, since the projection 22 of the adapter 20 functions as a guide to properly place the forward end portion 111 of the contact arm 110 at the root corner 41*a*, the nail 31*a* is driven exactly at the root corner 41*a* by pressing the edge 22*a* of the projection 22 at the root corner 41*a*, thereby retracting the contact arm 110 opposite to the nail driving direction relative to the driver guide 3, and pulling the trigger 6.

In the nail driving tool 100, the adapter 20 can be fixed in a circumferential attachment position relative to the contact arm 110 (hereinafter referred to as "a circumferential attachment position") selected from a plurality of positions along the circumferential direction of the contact arm 110 around the center line 23 (the axis 16). Therefore, the nail 31*b* can be driven properly even at the root corner 41*a*' of the floorboard 40*b* near the wall 45. If the nail driving tool 100 is used with the adapter 20 in the circumferential attachment position shown in FIG. 4, an end surface 5*a* of the magazine 5 contacts the wall 45 and prevents the nail 31*b* from being driven properly at the root corner 41*a*' of the floorboard 40*b*. However, by changing the circumferential attachment position of the adapter 20 as described below, the nail 31*b* can be driven properly at the root corner 41*a*' without the end surface 5*a* contacting the wall 45.

The circumferential attachment position of the adapter 20 is changed as follows in the present embodiment.

When the adapter 20 is rotated around the center line 23 manually by the user of the nail driving tool 100, the adapter 20 is deformed such that the two protrusions 28 do not engage with any of the recesses 117 and tops 28*a* of the protrusions 28 facing the center line 23 abut the outer surface 114. Then, the adapter 20 is further rotated to be in a desired circumferential attachment position where the two protrusions 28 engage with the corresponding two recesses 117.

Since the circumferential attachment position of the adapter 20 can be changed without removing the same as described above, it is not necessary to use a plurality of adapters to obtain the respective desired circumferential attachment. positions. Also, the efficiency of the nail driving operation is improved using the adapter 20 which need not be exchanged.

Further, the adapter 20 is securely held in the desired circumferential attachment position even when a big shock of the nail driving is transmitted to the adapter 20, because the two protrusions 28 are engaged with the two recesses 117 in the circumferential attachment position.

The adapter 20 in the desired circumferential attachment position is also securely held in a fixed position in the nail driving direction relative to the contact arm 110 (hereinafter referred to as "a fixed position in the nail driving direction"). Specifically, when the two protrusions 28 are engaged with the two recesses 117, respectively, with both ends 28*b*, 28*c* thereof along the nail driving direction abutting edges of the recesses 117, the engaging protrusion 29 is also engaged with the groove 119, and therefore the adapter 20 is securely held in the fixed position in the nail driving direction. As a result, the nail is driven to the same depth into the floorboard 40 (the object into which the nail is driven) even after the adapter 20 is rotated into another circumferential attachment position.

In the present embodiment, once the adapter 20 is attached, the engaging protrusion 29 is always engaged with the groove 119, which helps the two protrusions 28 engage with another two recesses 117 when the circumferential attachment position of the adapter 20 is changed. In contrast with the case where the groove 119 and the engaging protrusion 29 are not provided, the engaging protrusion 29 slides in the groove 119 when the adapter 20 is rotated, which keeps the adapter 20 in the fixed position in the nail driving direction and saves the labor of groping for the recesses 117 along the nail driving direction. Accordingly, it is relatively easy to engage two protrusions 28 with another two recesses 117.

Both the outer surface 114 of the forward end portion 111 and the inner surface 27 have approximately circular cross-sections in the present embodiment, and therefore the adapter 20 can be rotated smoothly into another circumferential attachment position.

Moreover, a click caused at the moment the two protrusions 28 are engaged with the two recesses 117 tells the user of the nail driving tool 100 that the adapter 20 is fixed in position, and thus prevents the nail driving with the adapter 20 out of position.

The numbers of the recesses 117 and the protrusions 28, which are eight and two, respectively, in the second embodiment, are variable when required. Specifically, as long as the protrusions 28 are configured to be engaged with different recesses 117 in accordance with the circumferential attachment position of the adapter 20, there is no limitation to the numbers of the protrusions 28 and the recesses 117 except that the number of the protrusions 28 is one or more and also equal to or smaller than that of the recesses 117.

The number of the protrusions 28 and the number of the recesses 117 may be the same depending on the configuration of the forward portion of the adapter 20 or for the convenience of the nail driving operation. If eight protrusions 28 corresponding to the eight recesses 117 in the second embodiment are provided, for example, all the eight protrusions 28 are engaged with the eight recesses 117 with the result that the adapter 20 is more securely fixed in the circumferential attachment position.

In the case where the adapter 20 is made of a hard material such as metal, the adapter 20 cannot be deformed when attached to the forward end portion 111 as much as in the second embodiment. However, if the recesses 117 are configured as elongate recesses extending to the edge 113 such that the adapter 20 is hardly elastically deformed when engaging the protrusions 28 with the recesses 117, and the groove 119 and the engaging protrusion 29 are not provided, the adapter 20 can be fixed in one of a plurality of circumferential attachment positions.

In this case, to change the circumferential attachment position of the adapter 20, the adapter 20 is once removed from the forward end portion 111, rotated to adjust the protrusions 28 thereof to the desired recesses 117, then attached on the forward end portion 111 again. The adapter 20 is securely fixed in the circumferential attachment position due to engagement of the protrusions 28 and the recesses 117 along with friction between the inner surface 27 and the outer surface 114 of the forward end portion 111.

The groove 119 need not be a continuous annular groove around the outer surface 114 of the forward end portion 111 as in the second embodiment, as long as the engaging protrusion 29 can slides therein when the adapter 20 once attached is rotated into another circumferential attachment position. In the case where the engaging protrusion 29 is an annular protrusion on the inner surface 27 as in the second embodiment, and the outer surface 114 of the forward end portion 111 is configured, at least around the place corresponding to the engaging protrusion 29, to have an approximately oval cross-section, for example, instead of a circular cross-section, it is necessary to provide the groove(s) 119 extending in the circumferential direction in the outer surface 114 only where the outer diameter of the forward end portion 111 is relatively large.

The engaging protrusion 29' need not be a continuous annular protrusion on the inner surface 27 as in the second embodiment, as long as the engaging protrusion 29 can slides in the groove 119 when the adapter 20 once attached is rotated into another circumferential attachment position. In the case where the groove 119 is a continuous annular groove as in the second embodiment, it is necessary to provide the engaging protrusions 29 only at the place corresponding to the groove 119 on the inner surface 27.

Oppositely to the second embodiment, the recesses 117 may be provided in the inner surface 27, and the protrusions 28 on the outer surface 114 of the forward end portion 111. Also, the groove 119 may be provided in the inner surface 27, and the engaging protrusion 29 on the outer surface 114 of the forward end portion 111.

Furthermore, instead of providing the above described recesses 117, the protrusions 28, the groove 119, and the engaging protrusion 29, the adapter 20 may be designed to be fixed on the forward end portion 111 merely due to friction between the inner surface 27 and the outer surface 114 of the forward end portion 111. Specifically, the adapter 20 composed of an elastic material such as rubber or plastic is deformed, when attached on the forward end portion 111, in accordance with the configuration thereof and fixed thereon due to friction between the inner surface 27 and the outer surface 114 of the forward end portion 111. In this case, even when the adapter 20 once attached is rotated into another desired circumferential attachment position by the user of the nail driving tool 100, the adapter 20 is deformed in accordance with the configuration of the forward end portion 111 and fixed in the circumferential attachment position due to the above mentioned friction. This type of adapter 20 enables its fixation in any desired circumferential attachment position on the forward end portion 111 even during the nail driving operation, therefore the efficiency of the operation is improved.

The edge 22*a* of the projection 22 of the adapter 20 in the nail driving direction, which is on a plane including the center line 23 of the through hole 21 in the second embodiment, may be configured to be off the above plane when required.

The portions 22*b*, 22*b*' of the projection 22, which are configured to protrude in the nail driving direction increasingly approaching a plane including the center line 23 linearly in the second embodiment, may be configured to approach the above plane curvedly when required.

The inner diameter D1' of the eject hole 112 in the vicinity of the edge 113 and the inner diameter d1' of the injection hole 3*a* near the forward end of the driver guide 3 in the nail driving direction, which are approximately the same in the second embodiment, may be such that D1'>d1'. In this case, the diameter of the through hole 21 of the adapter 20 is preferably smaller than D1', forward in the nail driving direction from the abutting surface 27*a* (i.e. the place at which the edge 113 of the contact arm 110 is located). In the second embodiment, since D1' and d1' are approximately the same, the inner surface 27, whose inner diameter is equal to D1' forward in the nail driving direction from the abutting surface 27*a*, can function as a nail guide. However, when D1'>d1', the inner diameter of the through hole 21 forward in the nail driving direction from the abutting surface 27*a* is preferably smaller than D1' so as to make the inner surface 27 function effectively as the nail guide. Further preferably, in this case, the inner diameter forward in the nail driving direction from the abutting surface 27*a* is approximately equal to D1' at least at a point in the vicinity of the edge 113 of the contact arm 110 and tapers in the nail driving direction so that the nail can pass the point without having its tip stuck.

Third Embodiment

Referring to FIG. 9, a third embodiment of the present invention is described. Similar elements, to those in the second embodiment are given the same signs, respectively, and the explanation of the same is omitted or simplified.

A nail driving tool according to the present embodiment is provided with an adapter 20' for the floorboard 40 attached on the forward end portion 111 of the contact arm 110 as the nail driving tool 100 of the second embodiment.

The only difference is that the adapter 20' does not have the shoulders 22*c*, 22*c*' included in the adapter 20. Specifically, the adapter 20' has a projection 51 configured such that portions 51*b*, 51*b*' of the outer surface 24 across the center line 23 increasingly approach a plane (not shown) including the center line 23 linearly.

Compared with the adapter 20 of the second embodiment, the adapter 20' enables the user to see more easily the edge 51*a* of the projection 51 (i.e. the point to drive a nail) which is placed at the root corners 41*a*, 41*a*' of the floorboards 40 when driving the nails 31*a*, 31*b* thereat. Accordingly, by using the nail driving tool of the present embodiment, the nails 31*a*, 31*b* are driven further precisely at the root corners 41*a*, 41*a*' as well as similar operation to that of the second embodiment can be achieved.

It is to be understood that the present invention is not limited to the embodiments described above, but may be embodied in various forms without departing from the spirit of the invention.

For example, although the adapter 20 (20') for the floorboard 40 is attached on the forward end portion 111 of the contact arm 110 to drive the nail exactly at the root corners 41*a*, 41*a*' of the floorboards 40 in the second and third embodiments, the edge 13 (113) of the forward end portion 11 (111) can be easily placed close to the root corners 41*a*, 41*a*' without using the adapter 20 (20') because the outer diameter of the outer surface 14 (114) in the forward end portion 11 (111) of the contact arm 10 (110) is tapered in all the three embodiments. As a result, the nails can be driven relatively precisely at the root corners 41*a*, 41*a*' without the adapter 20 (20').

When driving the nails at the root corners 41*a*, 41*a*' without using the adapter 20 (20'), the outer surface 14 (114) of the forward end portion 11 (111) is preferably chamfered in accordance with the shape of the floorboard 40 around the root corners 41*a*, 41*a*'.

While the outer diameter of the outer surface 14 (114) in the forward end portion 11 (111) of the contact arm 10 (110) is tapered in all the three embodiments, a cylindrical portion having a fixed diameter may be provided to extend from the tapered end in the nail driving direction.

What is claimed is:

1. A nail driving tool attachment for a nail driving tool, the nail driving tool attachment comprising:

a driver guide having a forward end and a rearward end, and the driver guide including an injection hole for driving a nail received from a nail driving tool, when attached thereto; and a contact arm extending in a nail driving direction of the driver guide, the contact arm surrounding an exterior surface of the forward end of the driver guide, the contact arm being movable relative to the driver guide along the nail driving direction of the driver guide toward the rearward end to facilitate activation of a triggering mechanism of the nail driving tool, when attached thereto, and the contact arm having an eject hole extending axially therethrough;

wherein an outer diameter of an exterior surface of the contact arm taperingly decreases, in the nail driving direction, toward a forward edge of the contact arm; and the eject hole of the contact arm has a fixed constant inner diameter, at a forward end of the contact arm, which is always equal to an inner diameter of the injection hole at the forward end of the driver guide.

2. The nail driving tool attachment according to claim 1, wherein the outer diameter of the exterior surface of the contact arm, in a vicinity of a forward end of the contact arm, is substantially equal to or smaller than an outer diameter of an exterior surface of the driver guide in a vicinity of the forward end of the driver guide.

3. The nail driving tool attachment according to claim 1, wherein an exterior surface of the contact arm has at least one spike thereon, adjacent the forward end thereof, to minimize slippage of the contact arm when a nail is to be driven obliquely by the nail driving tool attachment.

4. The nail driving tool attachment according to claim 1, wherein the nail driving tool attachment is further provided with an adapter which has a through hole extending through the adapter along the nail driving direction, and the adapter is detachably attached to a forward end portion of the contact arm by insertion of the forward end portion of the contact arm into the through hole of the adapter;

at least one area of the inwardly facing surface of the adapter and an exterior surface of the forward end portion of the contact arm has means for determining a circumferential attachment position which determines a position of the adapter relative to the contact arm, the means for determining the circumferential attachment position has a plurality of different attachment positions for the adapter about a circumference of the contact arm.

5. The nail driving tool attachment according to claim 4, wherein the means for determining the circumferential attachment position comprises:

at least two recesses provided on one of an inwardly facing surface of the through hole of the adapter and the exterior surface of the forward end portion of the contact arm;

mating protrusions of one or more equal to or less than the number of the recesses, provided on the other of the side of the inwardly facing surface of the through hole of the adapter and the exterior surface of the forward end portion of the contact arm, and the mating protrusions are designed to engage with the recesses at different positions corresponding to the plurality of different attachment positions of the adapter about the circumference of the contact arm.

6. The nail driving tool attachment according to claim 4, wherein a groove is provided on one of the inwardly facing surface of the through hole of the adapter and the outwardly facing surface of the forward end portion of the contact arm along the circumference of the surface;

an engaging protrusion is provided on the other of inwardly facing surface of the through hole of the adapter and the outwardly facing surface of the forward end portion of the contact arm and the engaging protrusion is located to mate with the groove upon attachment of the adapter; and when the adapter is attached to the forward end portion of the contact arm, the engaging protrusion engages with and is slidable within the groove such that a position of the adapter, relative to the contact arm in the nail driving direction, remains unchanged even when the adapter is rotated, with respect to the contact arm, about the center line of the through hole of the adapter.

7. The nail driving tool attachment according to claim 4, wherein a forward portion of the through hole of the adapter, which abuts against a forward most edge of the contact arm when the adapter is attached to the forward end portion of the contact arm, has an inner diameter which is equal to or less than the inner diameter of the eject hole of the contact arm adjacent the forward most edge of the contact arm.

8. The nail driving tool attachment according to claim 4, wherein the adapter is provided at an end part in the nail driving direction with a projection formed on two opposed exterior surfaces of the adapter across a center line of the through hole of the adapter.

9. A nail driving tool for driving a nail, the nail driving tool comprising:

a main body housing a reciprocally movable nail driver, the reciprocally movable nail driver being connectable to a source of pressurized air for driving a nail when the source of pressurized air activates the reciprocally movable nail driver;

a driver guide having a forward end and a rearward end, and the driver guide being connected to a discharge end of the main body and having an injection hole for driving a nail received from the reciprocally movable nail driver of the nail driving tool;

a nail feeding portion for feeding a nail to the nail driver;

a magazine for housing a supply of nails to be fed to the reciprocally movable nail driver via the nail feeding portion, the magazine being connected to the nail feeding portion;

a contact arm extending in a nail driving direction of the driver guide, the contact arm surrounding an exterior surface of the forward end of the driver guide, the contact arm being movable relative to the driver guide along the nail driving direction of the driver guide toward the rearward end to facilitate activation of a triggering mechanism of the nail driving tool, when attached thereto, and the contact arm having an eject hole extending axially therethrough;

wherein an outer diameter of an exterior surface of the contact arm taperingly decreases, in the nail driving direction, toward a forward edge of the contact arm; and the eject hole of the contact arm has a fixed constant inner diameter, at a forward end of the contact arm, which is always equal to an inner diameter of the injection hole at the forward end of the driver guide.

10. The nail driving tool according to claim 9, wherein the outer diameter of the exterior surface of the contact arm, in a vicinity of a forward end of the contact arm, is substantially equal to or smaller than an outer diameter of an exterior surface of the driver guide in a vicinity of the forward end of the driver guide.

11. The nail driving tool according to claim 9, wherein an exterior surface of the contact arm has at least one spike thereon, adjacent the forward end thereof, to minimize slippage of the contact arm when a nail is to be driven obliquely by the nail driving tool.

12. The nail driving tool according to claim 9, wherein the nail driving tool is further provided with an adapter which has a through hole extending through the adapter along the nail driving direction, and the adapter is detachably attached to a forward end portion of the contact arm by insertion of the forward end portion of the contact arm into the through hole of the adapter;

at least one area of the inwardly facing surface of the adapter and an exterior surface of the forward end portion of the contact arm has means for determining a circumferential attachment position which determines a position of the adapter relative to the contact arm, the means for determining the circumferential attachment position has a plurality of different attachment positions for the adapter about a circumference of the contact arm.

13. The nail driving tool according to claim 12, wherein the means for determining the circumferential attachment position comprises:

at least two recesses provided on one of an inwardly facing surface of the through hole of the adapter and the exterior surface of the forward end portion of the contact arm;

at least one mating protrusion, with a number of mating protrusions being equal to or less than a number of the recesses, provided on the other of the side of the inwardly facing surface of the through hole of the adapter and the exterior surface of the forward end portion of the contact arm, and the mating protrusions are designed to engage with the recesses at different positions corresponding to the plurality of different attachment positions of the adapter about the circumference of the contact arm.

14. The nail driving tool according to claim 12, wherein a groove is provided on one of the inwardly facing surface of the through hole of the adapter and the outwardly facing surface of the forward end portion of the contact arm along the circumference of the surface;

an engaging protrusion is provided on the other of inwardly facing surface of the through hole of the adapter and the outwardly facing surface of the forward end portion of the contact arm and the engaging protrusion is located to mate with the groove upon attachment of the adapter; and when the adapter is attached to the forward end portion of the contact arm, the engaging protrusion engages with and is slidable within the groove such that a position of the adapter, relative to the contact arm in the nail driving direction, remains unchanged even when the adapter is rotated, with respect to the contact arm, about the center line of the through hole of the adapter.

15. The nail driving tool according to claim 12, wherein a forward portion of the through hole of the adapter, which abuts against a forward most edge of the contact arm when the adapter is attached to the forward end portion of the contact arm, has an inner diameter which is equal to or less than the inner diameter of the eject hole of the contact arm adjacent the forward most edge of the contact arm.

16. The nail driving tool according to claim 12, wherein the adapter is provided at an end part in the nail driving direction with a projection formed on two opposed exterior surfaces of the adapter across a center line of the through hole increasingly approaching a plane including the center line of the through hole of the adapter.

* * * * *